United States Patent [19]

Auer et al.

[11] 3,970,271

[45] July 20, 1976

[54] DUAL FREQUENCY TRACK CIRCUIT

[75] Inventors: John H. Auer, Fairport, N.Y.; Willis R. Smith, Johannesburg, South Africa

[73] Assignee: General Signal Corporation, Rochester, N.Y.

[22] Filed: Mar. 27, 1975

[21] Appl. No.: 562,725

[52] U.S. Cl. ..... 246/34 R; 246/28 R

[51] Int. Cl.[2] ..... B61L 21/06

[58] Field of Search ..... 246/28 R, 34 R, 34 CT, 246/36, 39, 40, 46, 87, 89; 235/150.2, 150.24

[56] References Cited

UNITED STATES PATENTS

| | | | |
|---|---|---|---|
| 2,076,930 | 4/1937 | Young | 246/46 |
| 3,046,454 | 7/1962 | Staples | 246/34 R |

*Primary Examiner*—Trygve M. Blix
*Assistant Examiner*—Reinhard J. Eisenzopf
*Attorney, Agent, or Firm*—Milton E. Kleinman; George W. Killian

[57] ABSTRACT

There is disclosed a double rail track circuit for use within a railroad block or each cut section of a block. Adjacent cut sections, or blocks, are separated by insulated rail joints. A transmission line having terminals accessible at each joint is provided. The transmission line has impressed thereon a modulated carrier signal to provide a reference signal at the modulation frequency. The reference signal derived from the carrier is coupled to one end of each block, or cut section, in such a manner that the signals of adjacent blocks, or cut sections, are out of phase with respect to each other. A synchronous detector is coupled between the transmission line and the rails at the other end of the block, or cut section, to compare the phase of the signal at the other end, with the anticipated signal phase. Band-pass filters may be used between the rails and the synchronous detector and between the transmission line and the synchronous detector and which do not pass common frequencies. The system is less subject to interference from inductive coupling from power lines and/or from propulsion currents in the rails than systems employing a reference signal applied directly to a transmission line and coupled to the rails.

36 Claims, 1 Drawing Figure

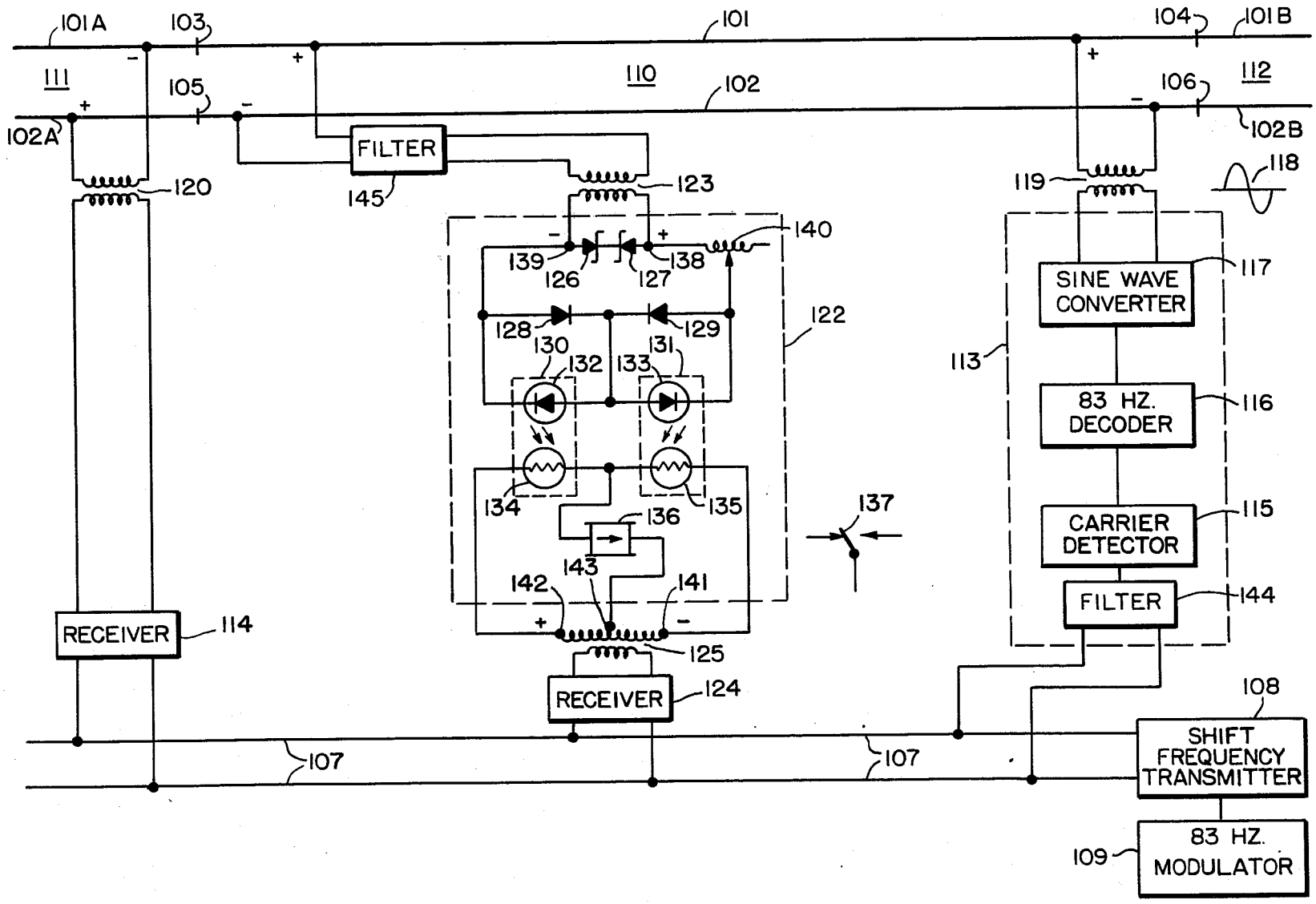
SINE WAVE CONVERTER
83 HZ. DECODER
CARRIER DETECTOR
FILTER
SHIFT FREQUENCY TRANSMITTER
83 HZ. MODULATOR
RECEIVER
RECEIVER
FILTER

DUAL FREQUENCY TRACK CIRCUIT

BACKGROUND OF THE INVENTION

In typical railroad control systems, a length of many miles of track may be divided into a plurality of successive adjacent blocks. When a block is too long to allow satisfactory operation with a single track circuit, the block is subdivided into a plurality of cut sections with a track circuit for each cut section. For the purposes of this description, it will be assumed that it is not necessary to subdivide the blocks into cut sections. However, it should be understood that the track circuit described herein will function with cut sections just as it does with blocks.

The track circuit provides means for detecting the presence or absence of a railroad vehicle in a given block. The information thus obtained is used for traffic control in allowing trains to operate at safe speeds and to identify their locations as they pass from one block to another. One method of distinguishing between the plurality of blocks of the system is to provide a means for electrically insulating the tracks of one block from the tracks of an adjacent block. That is, during the construction of the rail system, each rail of the double rail track is provided with an electrical insulator at suitable intervals. Accordingly, an electrical signal applied to one rail will be confined to one block because of the electrical insulation which isolates that rail from the adjacent blocks. It should be understood that when cut sections are used, there is insulation between rails of adjacent cut sections.

A wide variety of non-standard conditions and/or faults may result in a broken down insulation such that a signal applied to the rail of one block may be conducted to the rail of an adjacent block or blocks. Obviously, such failures may result in the loss of supervision over the railroad system and inaccurate identification of railroad vehicle location within the block system.

Both a.c. and d.c. track circuits have been used in the past and both have advantages and disadvantages. The track circuit disclosed herein is an a.c. track circuit. It is known that high frequency and low frequency track circuits each have advantages and disadvantages. More specifically, a low frequency track circuit works over substantial lengths, but is subject to interference from parallel low frequency circuits such as power lines and/or rail propulsion currents. High frequency track circuits are much less sensitive to induced interference but function over a more limited length and thus require an increased number of track circuits for a given total length of track.

SUMMARY OF THE INVENTION

The track circuit disclosed herein is an alternating current track circuit which has the advantages of both high frequency and low frequency. More specifically, the tolerance of the track circuit to interference from nearby power lines and/or propulsion current in the rails is similar to that obtained with high frequency track circuits. At the same time the length of track over which the track circuit functions is similar to that obtained with low frequency track circuits.

The system, according to the present invention, employs a low frequency track signal of the order of 83 hertz which is derived from a carrier wave which is suitably modulated by any convenient means. The carrier signal frequency may be of the order of 10 kilohertz but may be of any other frequency which is compatible with the type of transmission facility available and the design of the receiver 113. The carrier signal is transmitted on a transmission line which follows the route of the tracks. At the position of each track circuit apparatus is provided to detect the carrier, decode the low frequency signal and apply it to the track. The low frequency signal may be applied to one end of the block as a sine wave or any other suitable wave form. At the remote end of the block apparatus is coupled between the rail and the transmission line to test the signal on the track and compare it with the signal on the transmission line. If both signals have the proper phase relationship, a relay is maintained operated as is conventional and well known in the track circuit art.

In order to provide ancillary features, the signal is coupled to alternate blocks with one phase and to the intermediate blocks with another phase relationship. This facilitates the detection of broken down track insulation.

The disclosed embodiment uses optical isolators in the equipment at the remote end of the block to assist in overcoming lightning problems.

It is an object of the invention to provide an a.c. track circuit which has the advantages of both high frequency and low frequency track circuits without suffering the disadvantages of either.

It is a more specific object of the invention to provide a dual frequency track circuit. That is, one employing a low frequency signal in the track, but a high frequency signal in the transmission line.

It is another object of the invention to provide a track circuit whose capability to detect vehicles will not be reduced by defective insulated joints.

It is another object of the invention to provide a track circuit which can respond to defective insulated joints.

It is another object of the invention to use a common reference signal which is transmitted as a modulated carrier wave and coupled to each block within the system.

It is another object of the invention to provide a track circuit which has a minimum response to inductive coupling from power lines and/or propulsion currents in the rails.

It is another object of the invention to reduce the probability of induced currents causing a track clear signal when the track is occupied.

It is another object of the invention to maximize the probability that only signals derived from the reference signal influence the track relay.

BRIEF DESCRIPTION OF THE DRAWING

The drawing discloses the circuit of the invention coupled to one block of a railroad system and part of the similar connections of an adjacent block of the system.

DESCRIPTION OF THE PREFERRED EMBODIMENT

FIG. 1 illustrates a double rail track including rails 101, 101A, 101B, 102, 102A and 102B. For the purposes of controlling traffic, the system is divided into blocks by providing insulated joints at convenient intervals. For example, in FIG. 1, insulated joints are represented at 103, 104, 105 and 106 with the insulated joints 103 and 105 separating rail 101 from 101A and rail 102 from 102A, respectively. The insulated joints 104 and 106 separate rail 101 from 101B and rail 102 from 102B, respectively. The separation between the odd numbered pair of insulated joints and the even numbered pair of insulated joints may vary depending upon a wide number of circumstances, but normally will fall within the range of several hundred feet to a few miles. The track 101 between insulated joints 103 and 104 has electrical continuity. In a similar manner, the track 102 has electrical continuity between the insulated joints 105 and 106. The track 101A and 101B to the left and right, respectively, of insulated joints 103 and 104 are electrically isolated and insulated from the track 101. That is, unless the insulated joints 103 and 104 become defective, no currents in rail 101 will pass to rails 101A or 101B. Similar conditions prevail with respect to rails 102, 102A and 102B. Unfortunately, there may be circumstances and situations wherein an insulated joint, such as 103–106 becomes defective and current may pass through the joints.

A track circuit is coupled to each section of track bounded by pairs of insulated joints. As previously outlined, each such section may comprise an entire block or a cut section comprising only part of a block. For the purpose of this discussion, it will be assumed that the blocks are not divided and that each track circuit serves a block.

It is customary to detect the presence of a railroad vehicle in a particular block circuit by detecting the presence of a short circuit between the rails 101 and 102 of the block. That is, when a railroad vehicle enters a particular block, the wheels and axle of the train provide a short circuit between the rails of that block. In order to make the system as safe as possible, it has become standard practice to provide circuit design that will indicate the presence of a railroad vehicle in the event that there is any failure. This means, among other things, that when a block is unoccupied, a relay is maintained operated. A loss of power, or other failure, will release the relay and provide a signal indicating the block is occupied. Obviously, such signal will be erroneous, but such error is on the side of safety.

It should be understood that FIG. 1 illustrates the connections to a typical block and that similar connections are made to other blocks. The drawing shows some of the similar connections to an adjacent block.

The rails 101, 102 combined with the similar rails for adjacent blocks may extend for many miles. A signal transmission line follows substantially the same route as the rails so that there is access to the signal transmission line at each pair of insulated joints such as the pair 103, 105 and/or the pair 104, 106. The transmission line is represented by the line pair 107. Coupled to the transmission line 107 is a shift frequency transmitter 108 and coupled thereto is a modulator 109 which may be of the order of 83 hertz. The shift frequency transmitter 108 and the modulator 109 may be of any suitable type.

Near one end of each block circuit a receiver couples the rails 101 and 102 with the transmission line 107. For example for the block 110, which is bounded by the insulated joints 103 and 105 at one end and the insulated joints 104 and 106 at the other end, there is provided a receiver 113. Block 111 is adjacent to block 110 and shares the insulated joints 103 and 105 as a boundary. In a similar manner, block 112 is adjacent to block 110 and shares the insulated joints 104 and 106 as a common boundary. Receiver 114 is similar to receiver 113 and couples the rails 101A and 102A of block 111 with the transmission line 107. As may be seen the receiver 113 comprises a carrier detector 115, an 83 hertz decoder 116 and an alternating current converter such as sine wave converter 117. In addition, the receiver 113 may include a band pass filter 144 which will serve a function to be described. Receiver 114 and 124 comprise elements similar to the receiver 113, but for convenience are shown as a single block. The output of the receiver 113 is an alternating current signal which may be a sine wave as indicated at 118. The alternating current output of the receiver 113 is coupled to block 110 by transformer 119. In a similar manner, the output of receiver 114 is coupled to block 111 by transformer 120.

As a convenience in understanding some of the principles involved, polarity signs indicative of the polarity at a given instant have been applied to the outputs of the transformers 119, 120 and 125. It will be seen that when the transformer 119 is applying a positive signal to rail 101, the transformer 120 is applying a positive signal to rail 102A. Accordingly, at that instant, the rail 101A to the left of insulated joint 103 is at a negative potential while the rail 101 to the right of insulated joint 103 is at a positive potential. At the same time, the rail 102A to the left of insulated joint 105 will be positive and the rail 102 at the right of insulated joint 105 will be negative.

Each block circuit has a synchronous detector similar to the synchronous detector 122 shown for block 110. The synchronous detector 122 is connected to the block 110, at the end remote from the connection of receiver 113, by transformer 123. If conditions warrant, a band pass filter 145 may be used between the tracks 101, 102 and the transformer 123. The filter 145 can be used to block all but the desired signal frequency. When the filters 144 and 145 are used, they would be selected so they do not pass the same frequencies and therefore the possibility of a false signal from an induced current influencing the relay 136 would be even further reduced. The synchronous detector 122 is also coupled to the transmission line 107 by a transformer 125 and a receiver 124, which is similar to the receivers 113 and 114. As a practical matter of economy, the receivers 114 and 124 could be the same and the transformer 120 and 125 could be combined into a single transformer with two secondary windings.

A wide variety of synchronous detectors may be used. The illustrated synchronous detector 122 includes a pair of zener diodes 126 and 127, and diodes 128 and 129. In addition, the synchronous detector 122 includes a pair of photo coupling devices 130 and 131 which in turn include light emitting diodes 132 and 133, respectively, and light sensitive resistive elements 134 and 135, respectively. A relay 136 which has contact set 137 is coupled from the synchronous detector 122 to a center tap 143 on the transformer 125.

As already indicated, the relay 136 will remain operated when the block 110 is unoccupied and the operation of relay 136 will actuate contacts 137 in a manner to indicate that the block is not occupied. The means by which the contact set 137 provides signals indicative of the occupancy, or non-occupancy, of the block 110 by a railroad vehicle is well known in the art and therefore it is believed that no further details are required. In accordance with standard safety procedures, any equipment failure will tend to result in the release of relay 136 thereby providing a block occupied signal which, although erroneous, enhances safety.

As already indicated, the receiver 113 applies an a.c. signal through transformer 119 to the rails 101 and 102 of the block 110 at the end near insulated joints 104 and 106. This a.c. signal will be conducted through the rails 101 and 102 towards the insulated joints 103 and 105 and be applied to the transformer 123 filtered by filter 145 if used. When the terminal 138 is positive, with respect to terminal 139, conventional current will flow from terminal 138 through the adjustable inductor 140, diodes 129 and 132 to terminal 139. When terminal 139 is positive, with respect to terminal 138, conventional current will flow from terminal 139 through diodes 128 and 133 and adjustable inductor 140 to terminal 138. As already indicated, the diodes 132 and 133 are light emitting diodes and the light emitting diode 132 is associated with the light sensitive resistor 134. When the light emitting diode 132 is conducting, it is illuminated and the light sensitive resistor 134 assumes a resistance which is a relatively small fraction of its value when the light emitting diode 132 is not conducting and is dark. The relationship between light emitting diode 133 and its associated light sensitive resistor 135 is similar. These elements may conveniently comprise components made by the Vactec Company, Inc. having a part No. such as VTL2C1, VTL2C2, VTL2C3 or VTL2C4. Depending upon the choice of components, the resistance may vary between approximately 50 or 100 ohms to, at most, 10,000 ohms when light emitting diodes are illuminated. When the light emitting diodes are extinguished, the resistances will vary from approximately one half megohm to 100 megohms.

The receiver 124 is similar to the receiver 113 and will receive carrier frequency signals from transmission line 107 and will pass the reference signal to transformer 125. When terminal 144 of transformer 125 is positive, with respect to terminal 145, current will flow from terminal 144 through the light sensitive resistor 135 and relay 136 to the center tap 143 of transformer 125. At the same time, conventional current will flow from the center tap 143 through relay 136 and the light sensitive resistor 134 to terminal 145. The actual current in the relay will be the algebraic sum of these two opposing currents. The magnitudes of the described currents will be dependent upon the instantaneous value of the light sensitive resistors 134 and 135. For practical purposes, any current which flows through a light sensitive resistor 134 or 135 when that resistor is at high value is so small that it may be ignored. The relay 136 is a biased relay designed to actuate only in response to a flow of current in one direction. This feature is indicated by the arrow included within the symbol for the relay 136. Relays of this nature are sometimes referred to as a biased neutral relay and have been used in the railroad switching art for many years.

Considering now more specifically the actuation of biased relay 136, it will be seen that current may be passed through it in the direction of the arrow under two conditions, namely: (1) when terminal 144 is positive with respect to terminal 145 and simultaneously therewith the light sensitive resistor 135 is at a lower value than light sensitive resistor 134; and (2) when terminal 145 is positive with respect to terminal 144 and simultaneously therewith the light sensitive resistor 134 is at a lower value than light sensitive resistor 135. For the light sensitive resistor 135 to be at its low value, the light emitting diode 133 must be conducting and it will be conducting only when the terminal 139 is positive with respect to terminal 138. In other words, the relay 136 may be actuated when terminals 139 and 144 are positive with respect to terminals 138 and 145, respectively. In a similar manner, current may be conducted through relay 136 when terminals 145 and 138 are positive with respect to terminals 144 and 139, respectively. If terminal 144 should be positive with respect to terminal 145 at the time that light sensitive resistor 135 has a high resistance and light sensitive resistor 134 has a low resistance, a current will flow from terminal 143 through relay 136 and resistor 134 to terminal 145. However, because of the nature of the biased relay 136, no amount of backwards current can actuate the relay. Accordingly, relay 136 can be actuated only when there is a predetermined phase relationship between the polarities of the terminal pair 144 and 145 and the terminal pair 138 and 139. More specifically, when the signals from transformers 123 and 125 are in phase, the relay 136 will be actuated. If the signals are 180° out of phase, reverse current will flow in relay 136 and it will not operate. If the signals are about 90° out of phase, the resultant relay current will be nearly 0 and the relay 136 will not operate. The more nearly the signals are in phase, the greater the resultant current. Thus, the relay 136 will operate with some phase difference; but will release if the phase difference is excessive. The exact phase difference on which a particular relay will operate, hold and release is a function of relay design and adjustment.

In prior art, systems that applied the reference signal directly to the transmission line and that used the rails for propulsion current, there was the possibility that when the block was occupied, the propulsion current could influence the relay 136. At the same time the propulsion current could be induced in line 107 and influence relay 136 and thereby provide a track clear signal when it was occupied. In the present system, the receiver 124 receives the carrier signal and may include a filter 144 to block the propulsion current frequency. Accordingly, the present system is virtually immune to the outlined problem.

Obviously, care must be taken in making connections to and from the synchronous detector 122 in order to insure the desired phase relationship between the terminal pair 138 and 139 and the pair 144 and 145. Once the appropriate relationship and connections have been established, the relay 136 will remain actuated, unless the signal is lost, as happens with an occupied block, or if the phase relationship is sufficiently different, as may occur with a defective insulated joint pair.

It should be noted that there is a phase reversal on each side of the insulated joints 103 and 105. If the insulated joints 103 and 105 should become defective, the polarity of the potential applied to rails 101A and 102A may appear at transformer 123. That is, because of the resistance of rails 101 and 102 and the closer proximity of transformer 120 to the joints 103 and 105 than that of transformer 119, the potential from transformer 120 may dominate and appear at transformer 123. This would cause a difference in phase relationship applied to the synchronous detector 122 and the relay 136 would release.

The presence of a railroad vehicle in block 110 will provide a short circuit between the rails 101 and 102 and thereby prevent the application of potential to transformer 123. Under these conditions, neither of the light emitting diodes 132 or 133 will be illuminated and the light sensitive resistors 134 and 135 will remain at their high resistance values and insufficient current will be able to flow to actuate relay 136.

Because lives and equipment may be lost if the track circuit indicates safe conditions when such is not the fact, it is conventional to design circuits to be failsafe. That is, an inoperative or malfunctioning system must not indicate a safe condition. If is for this reason that railroad circuits sometimes have the appearance of being unduly complicated. In the present circuit, consideration was given to the possibility of the failure of the optical isolators 130 and 131 and particularly to the consequence of the photo resistors 134 and 135 remaining at their low resistance value and/or of one or both becoming shorted. If both 134 and 135 remain low, or become shorted, there will be zero resultant current in relay 136 and it will release. If only 134 or 135 remains low, or becomes shorted, analysis will show that the relay 136 cannot remain operated since current will not be maintained through the relay coil in the right direction. That is, the relay current will be a.c., not d.c., and the relay 136 will not operate in response to a.c. Photo transistors might be substituted for the elements 130 and 131, but since certain types of failure may result in their responding as diodes, the system would not be as safe. However, other circuits may be substituted for the synchronous detector 122. Also, a two phase vane relay may be used.

The variable inductance 140 provides a means for making adjustments to provide optimum conditions at the particular installation and specifically to adjust for line phase shift.

In low frequency track circuits of the prior art, there was a danger that signals from power lines and/or propulsion currents in the tracks could be induced into the transmission line 107 and cause false signals. The present system of using a carrier signal prevents this difficulty. Thus, if the track circuit is used on tracks which carry propulsion current, the propulsion frequency signals cannot appear at both inputs to the synchronous detector 122 and energize the track relay 136 falsely.

The track circuit may be used in systems which are subjected to severe lightning conditions. The zener diodes 126 and 127 help minimize the effects of lightning and/or propulsion current disturbances. It is anticipated that the transmission line 107 may comprise buried shielded cable.

Since the signal transmitted on the transmission line 107 is a high frequency signal with appropriate modulation, the transmission line 107 may also be used for other purposes. That is, the line 107 may also carry other intelligence in the form of d.c. or low frequency.

Because of the phase reversal between adjacent track circuits, each relay 136 responds only to signals from its own track circuit. Thus, the sensitivity to stray signals from an adjacent track circuit, as with poor joint insulation, is greatly reduced. The shorting of one joint of a pair of insulated joints would have little affect on the track circuit.

While there has been shown and described what is considered at present to be the preferred embodiment of the invention, modification thereto will readily occur to those skilled in the related arts. For example, other phase comparing circuits could be substituted and optical isolators might be eliminated, and a wide variety of carrier techniques could be employed. It is believed that no further analysis or description is required and that the foregoing so fully reveals the gist of the present invention that those skilled in the applicable art can adapt it to meet the exigencies of their specific requirements. It is not desired, therefore, that the invention be limited to the embodiment shown and described, and it is intended to cover in the appended claims all such modifications as fall within the true spirit and scope of the invention.

What is claimed is:

1. A double rail track circuit for a railroad block system comprising in combination:

a. first and second adjacent blocks of said block system with each rail of said first block insulated from the corresponding rail of said second block by isolating joints;

b. a transmission line having terminals accessible at said first and second blocks for providing a reference signal which is transmitted by said transmission line as a modulated carrier signal;

c. first and second means for coupling said reference signal from said transmission line to the rails of said first and second blocks, respectively, with the coupling to said first block being near said isolating joints and with the coupling to said second block being at its end remote from said isolating joints and with approximately 180° phase difference therebetween; and d. comparing means coupled between said transmission line and the rails of said second block near said isolating joints for comparing the phase relationship of the rail signal thereat with the phase of the reference signal on said transmission line, and to provide a signal indicative of the phase relationship.

2. The combination as set forth in claim 1, wherein said first and second means for coupling said reference signal from said transmission line to said rails comprises inductive coupling.

3. the combination as set forth in claim 1, wherein said comparing means includes an optical isolator.

4. The combination as set forth in claim 3, wherein said optical isolator includes a photo resistor and a light emitting diode.

5. The combination as set forth in claim 1, wherein said signal indicative of the phase relationship indicates:

a. a reasonably similar phase relationship; or b. a substantially different phase relationship, depending upon which condition prevails.

6. The combination as set forth in claim 1, and including;

a. first filter means coupled between said rails and said comparing means for inhibiting the application of signals above a predetermined frequency from said rails to said comparing means; and b. second filter means included in said second means for inhibiting the application of signals below said predetermined frequency from said transmission line to said comparing means.

7. The combination as set forth in claim 6, wherein said first and second filter means comprise first and second band-pass filters which pass frequencies of the order of said reference signal frequency and said carrier signal frequency, respectively.

8. The combination as set forth in claim 7, wherein said first and second band-pass filters both block at least some frequencies within the range between that of said reference signal and carrier signal.

9. A double rail track circuit for a block of a railroad block system comprising in combination:

a. first and second adjacent blocks with the rails of said first block electrically isolated one from the corresponding rails of said second block by a first pair of insulated joints, and with said first block terminated at its remote boundary by a second pair of insulated joints;

b. a transmission line for transmitting a reference signal as a modulated carrier signal and having terminals accessible in the vicinity of each of said pairs of insulated joints; and c. first and second receives for coupling said reference signal from said transmission line to the rails of said first and second blocks in the vicinity of said second and first pair of insulated rail joints, respectively, and so that different phases of the reference signal appear on the different sides of said first pair of insulated joints.

10. The combination as set forth in claim 9, wherein said reference signal is inductively coupled to the rails of said first and second blocks.

11. The combination as set forth in claim 9 and including:

a. a synchronous detector coupled between said transmission line and the rails of said first block near said first pair of insulated joints for comparing the phase relationship between the signal applied to said synchronous detector from the rails of said first block with the signal applied to said synchronous detector from said transmission line.

12. The combination as set forth in claim 11, wherein said synchronous detector includes an optical isolator.

13. The combination as set forth in claim 11, wherein said synchronous detector includes a biased relay.

14. The combination as set forth in claim 11 and including:

a. a first means for inhibiting signals above a predetermined frequency from being applied to said synchronous detector from said rails; and b. second means for inhibiting signals below said predetermined frequency from being applied to said synchronous detector line from said transmission line.

15. The combination as set forth in claim 14, wherein said predetermined frequency is between that of said reference signal and said carrier signal.

16. The combination as set forth in claim 15, wherein said first and second means comprise band-pass filters.

17. A double rail track circuit comprising:

a. a plurality of blocks, with the rails of each block electrically isolated from the corresponding rails of the adjacent blocks by pairs of insulated joints;

b. a transmission line for transmitting a reference signal superimposed on a carrier signal and having terminals accessible in the vicinity of each of said pairs of insulated joints;

c. a plurality of first coupling means with one associated with each alternate one of said blocks for coupling the reference signal from said transmission line to the rails of said alternate ones of said plurality of blocks and at a predetermined end of said blocks and with a predetermined phase relationship with said reference signal on said transmission line; and d. a plurality of second coupling means with one associated with each intermediate one of said blocks for coupling the reference signal from said transmission line to the rails of the intermediate ones of said plurality of blocks and at a predetermined end of said blocks and with a phase relationship which differs from said predetermined phase relationship.

18. The combination as set forth in claim 17, wherein each of said first and second coupling means is similar.

19. The combination as set forth in claim 17 and including a plurality of comparing means, with one each coupled between said transmission line and the end of an associated one of said plurality of blocks which is remote from said predetermined end, for comparing the phase relationship between the signal on the rails at said remote end and the reference signal from said transmission line.

20. The combination as set forth in claim 19, wherein each of said comparing means includes means for providing a first and second signal when the compared phases are substantially the same and when the compared phases are significantly different, respectively.

21. The combination as set forth in claim 20, wherein each of said comparing means includes an optical isolator.

22. The combination as set forth in claim 21, wherein each of said comparing means includes a biased relay.

23. The combination as set forth in claim 19 and including a first band-pass filter coupled between each of said comparing means and the associated rails and a second band-pass filter coupled between each of said comparing means and the transmission line.

24. The combination as set forth in claim 23, wherein said first and second band-pass filters both block at least some frequencies between that of said reference signal frequency and said carrier signal frequency.

25. An a.c. track circuit for a double rail system and comprising in combination:

a. a transmission line for conducting a reference a.c. signal from a source to the vicinity of said track circuit;

b. coupling means for coupling the reference signal from said transmission line to the rails of said track circuit at a predetermined point thereof;

c. comparing means coupled between said transmission line and the rails of said track circuit at a point remote from said predetermined point for comparing the phase relationship of the a.c. signal on the rails at said remote point with that of the reference signal on said transmission line;

d. signal means coupled to said comparing means for indicating that said phase relationship is either within or outside a predetermined difference and wherein;

e. said reference signal applied to said transmission line comprises a modulated carrier signal.

26. The combination as set forth in claim 25 and wherein said coupling means and said comparing means include detector and decoder means for extracting said reference signal from the modulated carrier signal on said transmission line.

27. The combination as set forth in claim 26 and including first and second band-pass filter means coupled to said comparing means for inhibiting the passage of signals above a predetermined frequency from passing from said rails to said comparing means and for inhibiting the passage of signals below a predetermined frequency from passing from said transmission line to said comparing means, respectively.

28. The combination as set forth in claim 27, wherein said predetermined frequency is between that of said reference signal and said carrier signal.

29. The combination as set forth in claim 25, wherein said comparing means includes an optical isolator.

30. The combination as set forth in claim 25, wherein said signal means comprises a biased relay.

31. The combination as set forth in claim 25 and including:

a. a second track circuit mechanically continuous with, but electrically isolated from, said first named track circuit and having individual coupling, comparing the signal means associated therewith for making said second track circuit function independent of said first named track circuit except that both said first named and said second track circuit derive their respective reference signals from the same transmission line.

32. The combination as set forth in claim 31 and wherein said coupling means of said first named and said second track circuits couple the reference signal from said transmission line to their respective track circuits with different phase relationships.

33. A double rail track circuit for a railroad block system comprising in combination;

a. a first block of said block system having its ends defined by insulating joints for electrically isolating the rails of said first block from the corresponding rails of the blocks adjacent to either end of said first block;

b. a transmission line having terminals accessible in the vicinity of said insulating joints for providing a reference signal;

c. coupling means for coupling said reference signal from said transmission line to the rails of said first block at one end thereof;

d. comparing means coupled from the rails of said first block, at the other end thereof, to said transmission line for comparing the phase relationship between the rail signals at said other end and that of the reference signal on said transmission line; and wherein e. said comparing means is coupled to said rails via first filter means for inhibiting signals above a predetermined frequency from being passed from said rails to said comparing means and wherein said comparing means is coupled to said transmission line via second filter means for inhibiting signals below said predetermined frequency from being passed from said transmission line to said comparing means.

34. The combination as set forth in claim 33, wherein said reference signal is transmitted on said transmission line as a modulated carrier signal.

35. The combination as set forth in claim 34, wherein said predetermined frequency is between the frequency of said reference signal and said carrier signal.

36. The combination as set forth in claim 35, wherein said comparing means provides first and second signals in response to a phase relationship within and outside, respectively, a predetermined limit.

* * * * *